US010598387B2

(12) United States Patent
Wang et al.

(10) Patent No.: US 10,598,387 B2
(45) Date of Patent: Mar. 24, 2020

(54) OVEN

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Cheng Wang, Foshan (CN); Kai Zhang, Foshan (CN); Xunzhang Wang, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 313 days.

(21) Appl. No.: 15/548,415

(22) PCT Filed: Apr. 14, 2015

(86) PCT No.: PCT/CN2015/076588
§ 371 (c)(1),
(2) Date: Nov. 14, 2017

(87) PCT Pub. No.: WO2016/127489
PCT Pub. Date: Aug. 18, 2016

(65) Prior Publication Data

US 2019/0203943 A1 Jul. 4, 2019

(30) Foreign Application Priority Data

Feb. 12, 2015 (CN) ..... 2015 1 0080438

(51) Int. Cl.
*F24C 3/12* (2006.01)
*F23N 1/00* (2006.01)

(52) U.S. Cl.
CPC ..... *F24C 3/128* (2013.01); *F23N 1/002* (2013.01); *F23N 1/005* (2013.01)

(58) Field of Classification Search
CPC ..... F24C 3/128; F23N 1/002; F23N 1/005; A21B 1/40
See application file for complete search history.

(56) References Cited

U.S. PATENT DOCUMENTS 2,562,536 A 7/1951 Mayer
3,606,606 A 9/1971 Luther
(Continued)

FOREIGN PATENT DOCUMENTS

CN 2088205 U 11/1991
CN 2148901 Y 12/1993
(Continued)

OTHER PUBLICATIONS

European Search Report dated Sep. 4, 2018 in the corresponding EP application(application No. 15881650.4).

*Primary Examiner* — Alfred Basichas
(74) *Attorney, Agent, or Firm* — Kilpatrick Townsend & Stockton, LLP

(57) ABSTRACT

The present invention provides an oven, including: an oven body; and a gas circuit system and an electric circuit system, both of which are installed on the oven body; the gas circuit system includes: a gas pipeline; a combustor installed in the oven body and being in communication with an outlet of the gas pipeline; a control switch installed on the gas pipeline; and an electric control valve controlling connection and disconnection of the gas pipeline together with the control switch; the electric circuit system includes: a controller connected to the electric control valve and matched with the control switch for use, wherein when the control switch is turned on, the controller switches on the electric control valve, and when the control switch is turned off, the controller switches off the electric control valve; and a timer.

16 Claims, 3 Drawing Sheets

(56) References Cited

U.S. PATENT DOCUMENTS

| | | | |
|---|---|---|---|
| 6,041,768 | A | 3/2000 | Giammona et al. |
| 2010/0251903 | A1 | 10/2010 | Maguire |
| 2012/0055459 | A1 | 3/2012 | Ley, III |

FOREIGN PATENT DOCUMENTS

| | | | |
|---|---|---|---|
| CN | 203241738 | U | 10/2013 |
| CN | 103654453 | A | 3/2014 |
| CN | 203953391 | U | 11/2014 |
| CN | 203953393 | U | 11/2014 |
| CN | 204091777 | U | 1/2015 |
| CN | 204445509 | U | 7/2015 |
| DE | 102010030944 | A1 | 1/2012 |
| EP | 0807789 | A1 | 11/1997 |
| EP | 1528326 | A2 | 5/2005 |
| GB | 2034020 | A | 5/1980 |
| GB | 2176910 | A | 1/1987 |
| JP | 2007236292 | A | 9/2007 |
| JP | 2012071106 | A | 4/2012 |
| WO | 2009037132 | A1 | 3/2009 |

OVEN

CROSS-REFERENCE TO RELATED APPLICATIONS

The present application is a national phase entry under 35 USC § 371 of International Application PCT/CN2015/076588, filed Apr. 14, 2015, which claims the benefit of and priority to Chinese Patent Application No. 201510080438.X, filed Feb. 12, 2015, the entire disclosures of which are incorporated herein by reference.

FIELD OF THE INVENTION

The present invention relates to the field of household appliances, and more particular to an oven.

BACKGROUND OF THE INVENTION

Ovens on the existing market are usually provided with timing devices, which usually work by countdown. When set time is ended, electronic buzzers or mechanical alarms on the timing devices will remind users to cut off gas sources by emitting alarm sound, and the ovens themselves cannot automatically cut off the gas sources. If the users do not hear the alarm and forget to cut off the gas sources, charring of food inside the ovens or fire and other potential safety hazards may be caused, in order to prevent accidents, the users must be in the vicinity of the ovens to hear the alarm, such that the users cannot be away from the ovens for a long time, resulting in inconvenience of use of the users.

SUMMARY OF THE INVENTION

The present invention aims at solving at one of the technical problems in the prior art.

To this end, the present invention provides an oven which automatically stops working by a timing function.

To achieve the above-mentioned purpose, an embodiment of a first aspect of the present invention provides an oven, including: an oven body; and a gas circuit system and an electric circuit system, both of which are installed on the oven body; the gas circuit system includes: a gas pipeline installed on the oven body; a combustor installed in the oven body and being in communication with an outlet of the gas pipeline; a control switch installed on the gas pipeline; and an electric control valve installed on the gas pipeline and controlling connection and disconnection of the gas pipeline together with the control switch; the electric circuit system includes: a controller installed on the oven body, connected to the electric control valve and matched with the control switch for use, wherein when the control switch is turned on, the controller switches on the electric control valve, and when the control switch is turned off, the controller switches off the electric control valve; and a timer installed on the oven body and connected to the controller, wherein when the timer times out, the timer can control the controller to switch off the electric control valve, so that the electric control valve disconnects the gas pipeline.

In summary, according to the oven provided by the embodiment of the present invention, the gas circuit system and the electric circuit system are installed on the oven body, the gas circuit system includes the gas pipeline, the combustor, the control switch and the electric control valve, wherein the gas pipeline is installed on the oven body, the combustor is installed in the oven body and is in communication with the outlet of the gas pipeline, the control switch and the electric control valve are installed on the gas pipeline and control the connection and disconnection of the gas pipeline; the electric circuit system includes the controller and the timer, the controller is installed on the oven body, is connected to the electric control valve and is matched with the control switch for use, when the control switch is turned on, the controller switches on the electric control valve, and when the control switch is turned off, the controller switches off the electric control valve; and the timer is installed on the oven body and is connected to the controller, when the timer times out, the controller switches off the electric control valve, so that the electric control valve disconnects the gas pipeline. The implementation mode of the solution is simple and reliable, the controller and the control switch are turned on or turned off at the same time, a user only needs to turn on one switch when using the oven, as the electric control valve controlled by the controller is installed on the gas pipeline, the oven can turn on the gas only in the working state of the controller, thereby improving the safety of the oven, meanwhile the controller can control the on-off of the electric control valve according to the state of the timer, so that the user can depart from the oven and perform other actions after a predetermined set time, after the timing time is ended, the controller closes a gas passage of the oven, the user does not need to close the oven by himself, thereby improving the degree of freedom of the user when using the oven, and also avoiding the risk of gas leakage and improving the safety of the oven.

In addition, the oven provided according to the above-mentioned embodiment of the present invention further has the following additional technical features:

According to an embodiment of the present invention, the electric control valve is located between the control switch and an inlet end of the gas pipeline.

According to an embodiment of the present invention, the timer is a mechanical timer or an electronic timer, and the electric control valve is a two-position two-way electric control valve.

According to the oven provided by the embodiment of the present invention, the electric control valve is connected to the gas pipeline in series, only the on-off of the gas pipeline needs to be controlled, and thus the simplest two-position two-way electric control valve is adopted; the control switch is a manual switch, which can be only turned on or turned off by the user, therefore in order to control the gas pipeline, the electric control valve must be connected between the control switch and the inlet end of the gas pipeline, when the electric control valve is switched off, even if the user does not turn off the control switch, no gas enters the oven from the gas pipeline, and thus the safety of the oven is improved.

According to an embodiment of the present invention, the electric circuit system further includes: a linked switch installed between the timer and the controller and matched with the control switch for use; wherein when the control switch is turned on, the linked switch is turned on, and when the control switch is turned off, the linked switch is turned off.

According to the oven provided by the embodiment of the present invention, the electric circuit system further includes the linked switch, and the linked switch is installed between the timer and the controller for controlling the connection and disconnection of signals between the timer and the controller. The linked switch is linked with the control switch, when the control switch is turned on, the linked switch is turned on, and when the control switch is turned off, the linked switch is turned off. In this case, the user does not need to turn on two switches when using the oven, thereby reducing the operation difficulty of the oven.

According to an embodiment of the present invention, the timer is connected to a main path of the electric circuit system in parallel, and the linked switch and the controller are connected to the main path of the electric circuit system in series.

According to the oven provided by the embodiment of the present invention, the controller and the linked switch are connected to the main path of the electric circuit system in series, and moreover, the linked switch and the control switch form a linkage relationship, so the user can turn on or turn off the controller through the control switch to drive the oven to start working or stop working; the timer is connected to the main path of the electric circuit system in parallel, so the user can set the timer to enable the controller to receive a timing signal to control the electric control valve, or the user can also not set the timer and locate the timer in a zeroing state, the controller continues to control the electric control valve, therefore the control is convenient and flexible, and the operability and the product quality of the oven are improved.

According to an embodiment of the present invention, the timer includes a first IC chip.

According to an embodiment of the present invention, the controller is a second IC chip.

According to the oven provided by the embodiment of the present invention, the first IC chip is a timing chip, the controller is the second IC chip, a signal input end of the second IC chip is connected with an output end of the first IC chip, and the electric control valve is electrically connected with the output end of the controller; the first IC chip sends a signal to the controller, and the controller controls the on-off of the electric control valve according to the signal of the first IC chip so as to control the connection and disconnection of the gas pipeline. The controller can be a singlechip, a program is written in the singlechip in advance, the singlechip receives the signal of the first IC chip, the signal is output from the output end of the singlechip after being judged by the program so as to control the on-off of the electric control valve, a plurality of timers can be set in this implementation mode, and the singlechip performs a variety of continuous actions according to different signals of the plurality of timers, therefore the functionality is high, the intelligence is high, and the functions of the oven can be upgraded.

According to an embodiment of the present invention, the controller includes a first resistor, a triode and a diode, which are connected with one another, wherein the diode and the electric control valve are connected in parallel.

According to an embodiment of the present invention, the controller further includes a second resistor; wherein a first end of the first resistor is connected with an output end of the first IC chip, and a second end of the first resistor is connected with a base of the triode; a collector of the triode is connected with an anode of the diode and the first end of the electric control valve, an emitter of the triode is grounded, and the second resistor is connected between the base and the emitter of the triode; and a cathode of the diode is connected with a DC power supply after being connected with a second end of the electric control valve.

According to the oven provided by the embodiment of the present invention, the first IC chip is the timer, the output end of the first IC chip is connected with the first end of the first resistor, and the second end of the first resistor is connected with the base of the triode to form a signal circuit of the timer; the collector of the triode is connected with the anode of the diode and the first end of the electric control valve, the emitter of the triode is grounded, and the cathode of the diode is connected with the DC power supply after being connected with the second end of the electric control valve so as to form a control circuit of the electric control valve; and after the timing of the first IC chip is ended, the output end sends a high-level signal to the base of the triode to switch on the triode, and the electric control valve is energized accordingly, makes response and performs a corresponding action so as to control the disconnection of the gas pipeline. This implementation mode is simple and reliable, is low in cost and is conducive to reducing the production cost of the oven and improving the productivity of the oven.

According to an embodiment of the present invention, the controller further includes a second resistor; wherein the first end of the first resistor is connected with the output end of the first IC chip, and the second end of the first resistor is connected with the base of the triode; the emitter of the triode is connected with the cathode of the diode and the first end of the electric control valve, the collector of the triode is grounded, and the second resistor is connected between the base and the emitter of the triode; and the anode of the diode is connected with the DC power supply after being connected with the second end of the electric control valve.

According to the oven provided by the embodiment of the present invention, the first end of the first resistor is connected with the output end of the first IC chip, and the second end of the first resistor is connected with the base of the triode to form the signal circuit of the timer; the emitter of the triode is connected with the cathode of the diode and the first end of the electric control valve, the collector of the triode is grounded, and the anode of the diode is connected with the DC power supply after being connected with the second end of the electric control valve so as to form the control circuit of the electric control valve; and the second resistor is connected between the base and the emitter of the triode, therefore only when the output end of the first IC chip is at a low level, the base of the triode can receive signals. After the base of the triode receives a voltage signal, the control circuit of the electric control valve is turned on, the electric control valve makes response accordingly and performs a corresponding action so as to control the disconnection of the gas pipeline. This implementation mode is simple and reliable, is low in cost and is conducive to reducing the production cost of the oven and improving the productivity of the oven.

Additional aspects and advantages of the present invention will become apparent from the following description, or may be learned by the practice of the present invention.

BRIEF DESCRIPTION OF THE DRAWINGS

The foregoing and/or additional aspects and advantages of the present invention will become apparent and understandable from the following description of the embodiments in conjunction with the accompanying drawings, in which.

Figure 1:
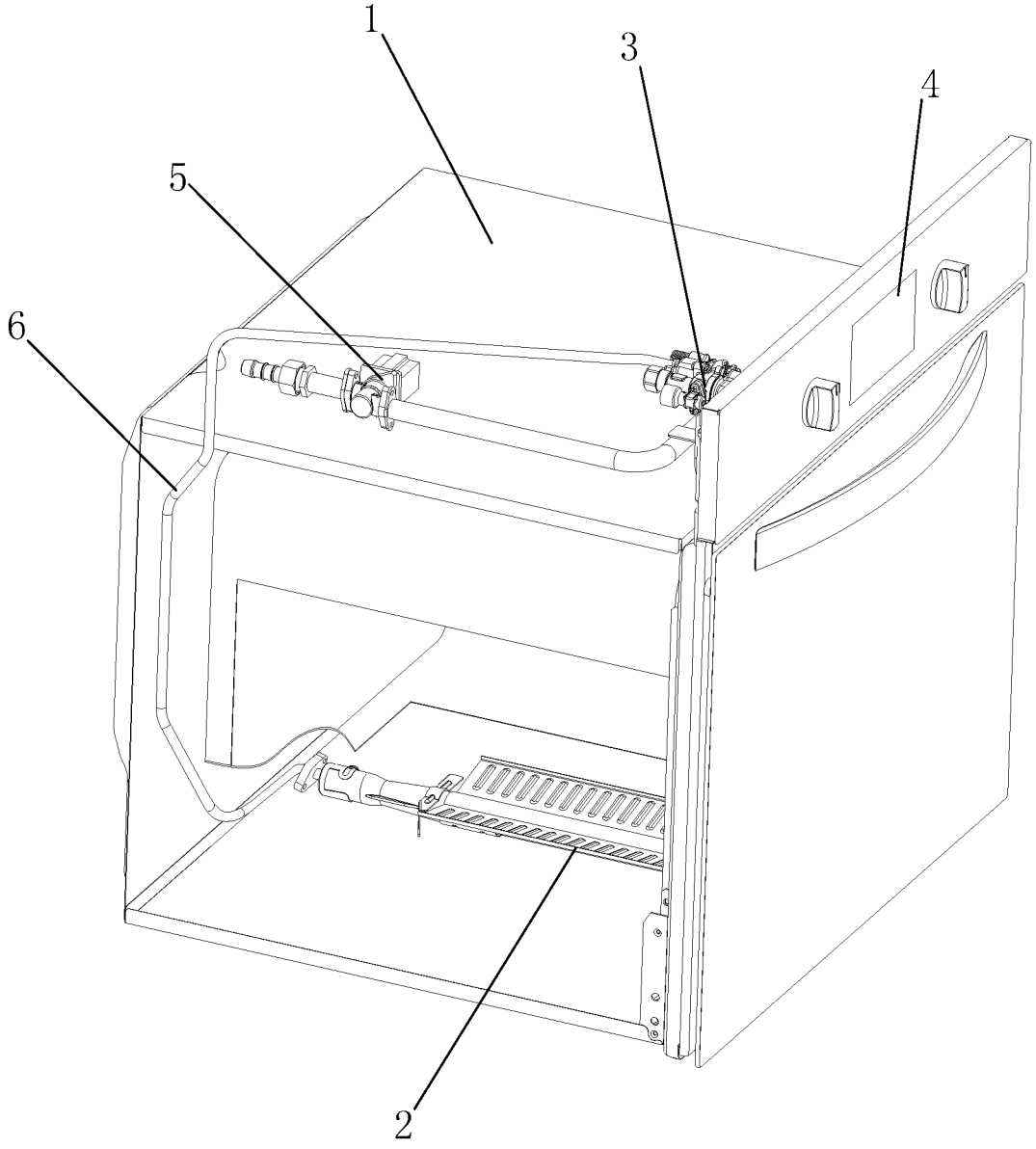
FIG. 1 is a structural schematic diagram of an oven according to an embodiment of the present invention.

The corresponding relation between reference signs and component names in FIG. 1 is as follows: 1 oven body, 2 combustor, 3 control switch, 4 timer, 5 electric control valve, 6 gas pipeline.

DETAILED DESCRIPTION OF THE EMBODIMENTS

In order that the above-mentioned purposes, features and advantages of the present invention are clearer, the present invention will be further described in detail below in combination with accompanying drawings and embodiments. It should be noted that the embodiments and the features in the embodiments of the present application may be combined with each other without conflict.

Numerous specific details are set forth in the following description to facilitate a thorough understanding of the present invention, but the present invention may be implemented in other manners otherwise than as described herein, and thus the protection scope of the present invention is not limited to the specific embodiments disclosed below.

As shown in FIG. 1, an oven provided according to some embodiments of the present invention includes: an oven body 1; and a gas circuit system and an electric circuit system, both of which are installed on the oven body 1; the gas circuit system includes: a gas pipeline 6 installed on the oven body 1; a combustor 2 installed in the oven body 1 and being in communication with an outlet of the gas pipeline 6; a control switch 3 installed on the gas pipeline 6; and an electric control valve 5 installed on the gas pipeline 6 and controlling connection and disconnection of the gas pipeline 6 together with the control switch 3 (the two components play a dual protection role); the electric circuit system includes: a controller installed on the oven body 1, connected to the electric control valve 5 and matched with the control switch 3 for use, wherein when the control switch 3 is turned on, the controller switches on the electric control valve 5, and when the control switch 3 is turned off, the controller switches off the electric control valve 5; and a timer 4 installed on the oven body 1 and connected to the controller, wherein when the timer times out, the timer can control the controller to switch off the electric control valve 5, so that the electric control valve 5 disconnects the gas pipeline 6.

In summary, according to the oven provided by the embodiments of the present invention, the gas circuit system and the electric circuit system are installed on the oven body 1, the gas circuit system includes the gas pipeline 6, the combustor 2, the control switch 3 and the electric control valve 5, wherein the gas pipeline 6 is installed on the oven body 1, the combustor 2 is installed in the oven body 1 and is in communication with the outlet of the gas pipeline 6, the control switch 3 and the electric control valve 5 are installed on the gas pipeline 6 and control the connection and disconnection of the gas pipeline 6; the electric circuit system includes the controller and the timer 4, the controller is installed on the oven body 1, is connected to the electric control valve 5 and is matched with the control switch 3 for use, when the control switch 3 is turned on, the controller switches on the electric control valve 5, and when the control switch 3 is turned off, the controller switches off the electric control valve 5; and the timer 4 is installed on the oven body 1 and is connected to the controller, when the timer times out, the controller switches off the electric control valve 5, so that the electric control valve 5 disconnects the gas pipeline 6. The implementation mode of the solution is simple and reliable, the controller and the control switch 3 are turned on or turned off at the same time, a user only needs to turn on one switch when using the oven, as the electric control valve 5 controlled by the controller is installed on the gas pipeline 6, the oven can turn on the gas only in the working state of the controller, thereby improving the safety of the oven, meanwhile the controller can control the on-off of the electric control valve 5 according to the state of the timer 4, so that the user can depart from the oven and perform other actions after a predetermined set time, after the timing time is ended, the controller closes a gas passage of the oven, the user does not need to close the oven by himself, thereby improving the degree of freedom of the user when using the oven, and meanwhile avoiding the risk of gas leakage and improving the safety of the oven.

Figure 2:
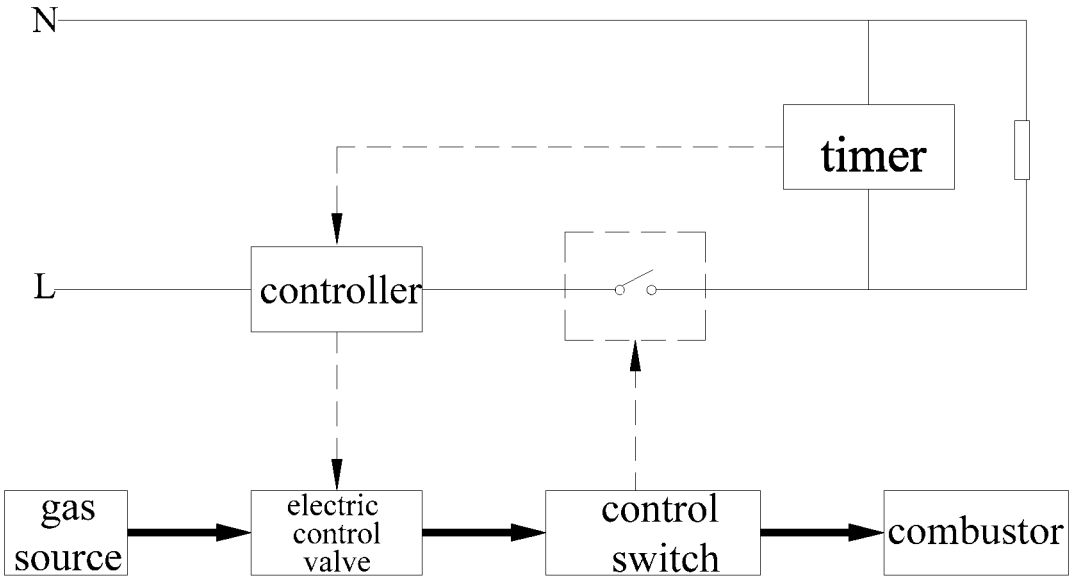
FIG. 2 is an operation block diagram of the oven according to an embodiment of the present invention.

In addition, the oven provided according to the above-mentioned embodiments of the present invention further has the following additional technical features:

As shown in FIG. 2, according to an embodiment of the present invention, the electric control valve 5 is located between the control switch 3 and an inlet end of the gas pipeline 6.

According to an embodiment of the present invention, the timer 4 is a mechanical timer or an electronic timer, and the electric control valve 5 is a two-position two-way electric control valve.

According to the oven provided by the embodiment of the present invention, the electric control valve 5 is connected to the gas pipeline 6 in series, only the on-off of the gas pipeline 6 needs to be controlled, and thus the simplest two-position two-way electric control valve 5 is adopted; the control switch 3 is a manual switch, which can be only turned on or turned off by the user, therefore in order to control the gas pipeline 6, the electric control valve 5 must be connected between the control switch 3 and the inlet end of the gas pipeline 6, when the electric control valve 5 is switched off, even if the user does not turn off the control switch 3, no gas enters the oven from the gas pipeline 6, and thus the safety of the oven is improved.

According to an embodiment of the present invention, the electric circuit system further includes: a linked switch installed between the timer 4 and the controller and matched with the control switch 3 for use; wherein when the control switch 3 is turned on, the linked switch is turned on, and when the control switch 3 is turned off, the linked switch is turned off.

According to the oven provided by the embodiment of the present invention, the electric circuit system further includes the linked switch, which is installed between the timer 4 and the controller for controlling the connection and disconnection of signals between the timer 4 and the controller. The linked switch is linked with the control switch 3, when the control switch 3 is turned on, the linked switch is turned on, and when the control switch 3 is turned off, the linked switch is turned off. In this case, the user does not need to turn on two switches when using the oven, thereby reducing the operation difficulty of the oven.

As shown in FIG. 2, according to an embodiment of the present invention, the timer 4 is connected to a main path of the electric circuit system in parallel, and the linked switch and the controller are connected to the main path of the electric circuit system in series.

According to the oven provided by the embodiment of the present invention, the controller and the linked switch are connected to the main path of the electric circuit system in series, and moreover, the linked switch and the control switch 3 form a linkage relationship, so the user can turn on or turn off the controller through the control switch 3 to drive the oven to start working or stop working; the timer 4 is connected to the main path of the electric circuit system in parallel, so the user can set the timer 4 to enable the controller to receive a timing signal to control the electric control valve 5, or the user can also not set the timer 4 and locate the timer 4 in a zeroing state, the controller continues to control the electric control valve 5, therefore the control is convenient and flexible, and the operability and the product quality of the oven are improved.

Figure 3:
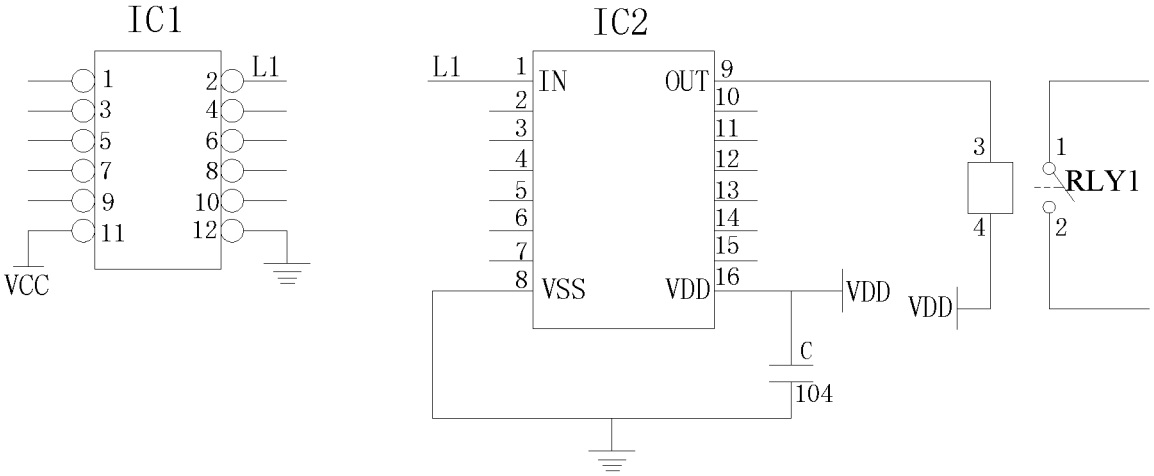
FIG. 3 is a control principle diagram of the oven according to an embodiment of the present invention.

As shown in FIG. 3, according to an embodiment of the present invention, the timer includes a first IC chip.

According to an embodiment of the present invention, the controller is a second IC chip.

According to the oven provided by the embodiment of the present invention, the first IC chip is a timing chip, the controller is the second IC chip, a signal input port 1 of the second IC chip is connected with an output port 2 of the first IC chip, a coil port 3 of an electric control valve PLY1 is connected with an output port 16 of the second IC chip, and a coil port 4 of the electric control valve PLY1 is connected with a voltage source VDD; and the output port 2 of the first IC chip sends a signal to the input port 1 of the second IC chip, and the output port 16 of the second IC chip outputs a low level to connect a coil of the electric control valve PLY1 to control the on-off of the electric control valve PLY1 so as to control the disconnection of the gas pipeline. The controller can be a singlechip, a program must be written in the singlechip in advance, the singlechip receives the signal of the first IC chip, the signal is output from the output end of the singlechip after being judged by the program so as to control the on-off of the electric control valve PLY1, a plurality of timers can be set in this implementation mode, and the singlechip performs a variety of continuous actions according to different signals of the plurality of timers, therefore the functionality is high, the intelligence is high, and the functions of the oven can be expanded and upgraded.

Figure 4:
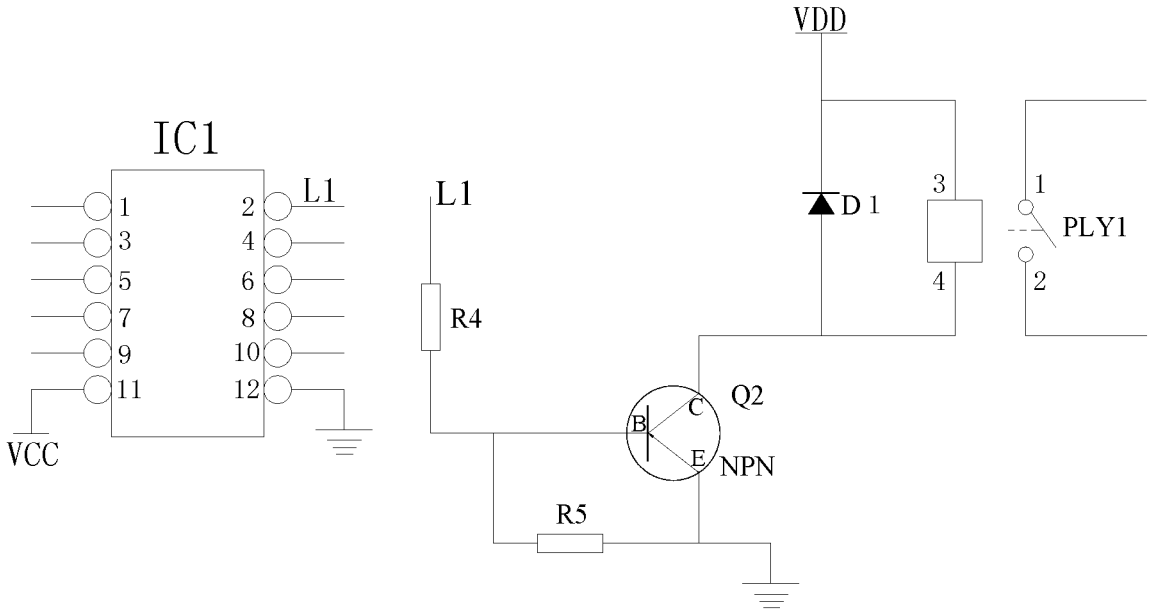
FIG. 4 is another control principle diagram of the oven according to an embodiment of the present invention.
Figure 5:
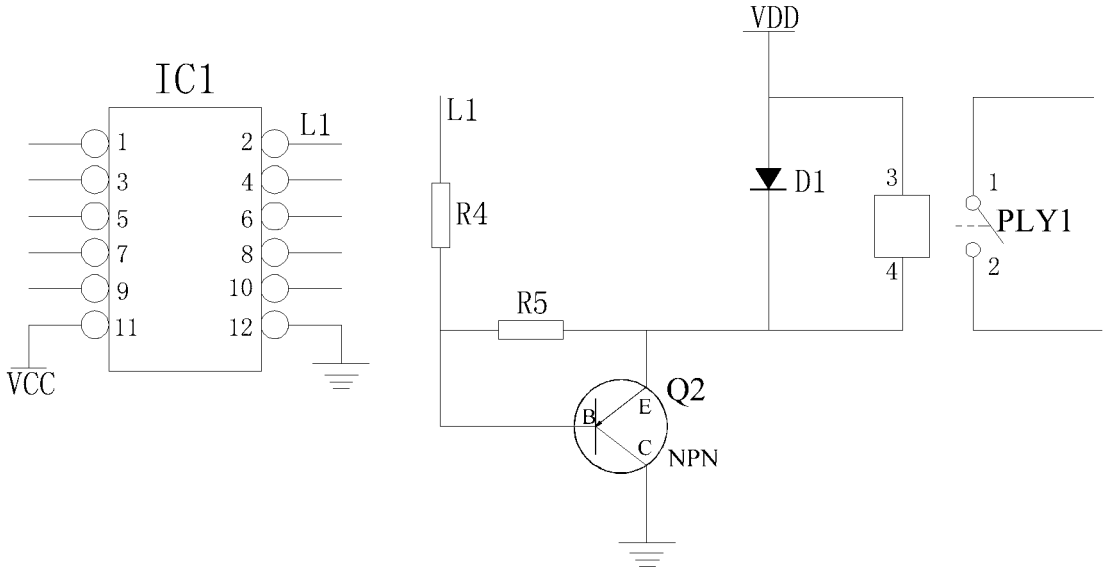
FIG. 5 is yet another control principle diagram of the oven according to an embodiment of the present invention.

As shown in FIG. 4 and FIG. 5, according to an embodiment of the present invention, the controller includes a first resistor R4, a triode Q2 and a diode D1, which are connected with one another, wherein the diode D1 and the electric control valve PLY1 are connected in parallel.

As shown in FIG. 4, according to another embodiment of the present invention, the controller can further includes a second resistor R5; wherein a first end of the first resistor R4 is connected with an output end of the first IC chip, and a second end of the first resistor is connected with a base of the triode Q2; a collector of the triode Q2 is connected with an anode of the diode D1 and the first end of the electric control valve PLY1, an emitter of the triode is grounded, and the second resistor R5 is connected between the base and the emitter of the triode Q2; and a cathode of the diode D1 is connected with a DC power supply VDD after being connected with a second end of the electric control valve PLY1.

According to the oven provided by the embodiment of the present invention, the first IC chip is the timer, the output end of the first IC chip is connected with the first end of the first resistor R4, and the second end of the first resistor R4 is connected with the base of the triode Q2 to form a signal circuit of the timer; the collector of the triode Q2 is connected with the anode of the diode D1 and the first end of the electric control valve PLY1, the emitter of the triode is grounded, and the cathode of the diode D1 is connected with the DC power supply after being connected with the second end of the electric control valve PLY1 so as to form a control circuit of the electric control valve PLY1.

During specific work, as the first IC chip is provided, the first IC chip outputs a high level to the R4 through the port 2, the triode Q2 is switched on, then voltage of the VDD is applied across the both ends of the coil of the electric control valve PLY1, and the electric control valve PLY1 is turned on. A timing time TO is set for the first IC chip, after the first IC chip reaches the timing time, the first IC chip outputs a low level to the R4 through the port 2, the triode Q2 is cut off, 0V voltage is applied across the both ends of the coil of the electric control valve PLY1, the electric control valve PLY1 is turned off, and thus the electric control valve PLY1 periodically cuts off the gas pipeline. This implementation mode is simple and reliable, is low in cost and is conducive to reducing the production cost of the oven and improving the productivity of the oven.

As shown in FIG. 5, according to yet another embodiment of the present invention, the controller further includes a second resistor R5; wherein the first end of the first resistor R4 is connected with the output end of the first IC chip, and the second end of the first resistor R4 is connected with the base of the triode Q2; the emitter of the triode Q2 is connected with the cathode of the diode D1 and the first end of the electric control valve PLY1, the collector of the triode is grounded, and the second resistor R5 is connected between the base and the emitter of the triode Q2; and the anode of the diode D1 is connected with the DC power supply VDD after being connected with the second end of the electric control valve PLY1.

According to the oven provided by the embodiment of the present invention, the first end of the first resistor is connected with the output end of the first IC chip, and the second end of the first resistor is connected with the base of the triode to form the signal circuit of the timer; the emitter of the triode is connected with the cathode of the diode and the first end of the electric control valve, the collector of the triode is grounded, and the anode of the diode is connected with the DC power supply after being connected with the second end of the electric control valve so as to form the control circuit of the electric control valve; and the second resistor is connected between the base and the emitter of the triode, therefore when the output end of the first IC chip is at a low level, the base of the triode can receive signals.

During specific work, as the first IC chip is provided, the first IC chip outputs a low level to the R4 through the port 2, the triode Q2 is switched on, then voltage of the VDD is applied across the both ends of the coil of the electric control valve PLY1, and the electric control valve PLY1 is turned on. A timing time TO is set for the first IC chip, after the first IC chip reaches the timing time, the first IC chip outputs a high level to the R4 through the port 2, the triode Q2 is cut off, 0V voltage is applied across the both ends of the coil of the electric control valve PLY1, the electric control valve PLY1 is turned off, and thus the electric control valve PLY1 periodically cuts off the gas pipeline. After the base of the triode Q2 receives a voltage signal, the control circuit of the electric control valve PLY1 is turned on, the electric control valve PLY1 makes response accordingly and performs a corresponding action so as to control the disconnection of the gas pipeline. This implementation mode is simple and reliable, is low in cost and is conducive to reducing the production cost of the oven and improving the productivity of the oven.

In FIG. 3 to FIG. 5, IC1 represents the first IC chip, and IC2 represents the second IC chip.

In the description of the present invention, the terms "installed", "connected", "connection", "fixed" and the like all should be broadly understood. For example, the "connection" can be a fixed connection, a detachable connection, or an integral connection, and can be either directly connected or indirectly connected through an intermediary. Those of ordinary skill in the art can understand the specific meaning of the above-mentioned terms in the present invention in light of specific circumstances.

In the description of this specification, the description of the terms "one embodiment", "some embodiments", "specific embodiments" and the like means that the specific features, structures, materials or features described in combination with the embodiments or examples are included in at least one embodiment or example of the present invention. In the present specification, the schematic expression of the above-mentioned terms does not necessarily refer to the same embodiment or example. Moreover, the particular features, structures, materials or characteristics described may be combined in any one or more embodiments or examples in any suitable manner.

The foregoing descriptions are merely preferred embodiments of the present invention, rather than limiting the present invention. For those skilled in the art, the present invention may have various variations and deformations. Any modifications, equivalent substitutions, improvements and the like made within the spirit and principle of the present invention shall all be within the protection scope of the present invention.

The invention claimed is:

1. An oven, comprising:

an oven body; and a gas circuit system and an electric circuit system, both of which are installed on the oven body; wherein the gas circuit system comprises:

a gas pipeline installed on the oven body;

a combustor installed in the oven body and being in communication with an outlet of the gas pipeline;

a control switch installed on the gas pipeline; and an electric control valve installed on the gas pipeline and controlling connection and disconnection of the gas pipeline together with the control switch; the electric circuit system comprises:

a controller installed on the oven body, connected to the electric control valve and matched with the control switch for use, wherein when the control switch is turned on, the controller switches on the electric control valve, and when the control switch is turned off, the controller switches off the electric control valve; and a timer installed on the oven body and connected to the controller, and when the timer times out, the timer can control the controller to switch off the electric control valve, so that the electric control valve disconnects the gas pipeline;

wherein the timer comprises a first IC chip, the first IC chip is a timing chip;

wherein the controller is a second IC chip comprising a single chip processor;

wherein the single chip processor is configured to receive and process signal from the first IC chip, and output instruction to the electric control valve to control its on-off.

2. The oven of claim 1, wherein, the electric control valve is located between the control switch and an inlet end of the gas pipeline.

3. The oven of claim 2, wherein the electric control valve is a two-position two-way electric control valve.

4. The oven of claim 3, wherein the electric circuit system further comprises:

a linked switch installed between the timer and the controller and matched with the control switch for use; wherein when the control switch is turned on, the linked switch is turned on, and when the control switch is turned off, the linked switch is turned off.

5. The oven of claim 4, wherein, the timer is connected to a main path of the electric circuit system in parallel, and the linked switch and the controller are connected to the main path of the electric circuit system in series.

6. The oven of claim 5, wherein, the controller comprises a first resistor, a triode and a diode, which are connected with one another, wherein the diode and the electric control valve are connected in parallel.

7. The oven of claim 2, wherein the electric circuit system further comprises:

a linked switch installed between the timer and the controller and matched with the control switch for use; wherein when the control switch is turned on, the linked switch is turned on, and when the control switch is turned off, the linked switch is turned off.

8. The oven of claim 7, wherein, the timer is connected to a main path of the electric circuit system in parallel, and the linked switch and the controller are connected to the main path of the electric circuit system in series.

9. The oven of claim 8, wherein, the controller comprises a first resistor, a triode and a diode, which are connected with one another, wherein the diode and the electric control valve are connected in parallel.

10. The oven of claim 9, wherein, the controller further comprises a second resistor; wherein a first end of the first resistor is connected with an output end of the first IC chip, and a second end of the first resistor is connected with a base of the triode;

a collector of the triode is connected with an anode of the diode and the first end of the electric control valve, an emitter of the triode is grounded, and the second resistor is connected between the base and the emitter of the triode; and a cathode of the diode is connected with a DC power supply after being connected with a second end of the electric control valve.

11. The oven of claim 9, wherein, the controller further comprises a second resistor; wherein the first end of the first resistor is connected with the output end of the first IC chip, and the second end of the first resistor is connected with the base of the triode;

the emitter of the triode is connected with the cathode of the diode and the first end of the electric control valve, the collector of the triode is grounded, and the second resistor is connected between the base and the emitter of the triode; and the anode of the diode is connected with the DC power supply after being connected with the second end of the electric control valve.

12. The oven of claim 1, wherein the electric circuit system further comprises:

a linked switch installed between the timer and the controller and matched with the control switch for use; wherein when the control switch is turned on, the linked switch is turned on, and when the control switch is turned off, the linked switch is turned off.

13. The oven of claim 12, wherein, the timer is connected to a main path of the electric circuit system in parallel, and the linked switch and the controller are connected to the main path of the electric circuit system in series.

14. The oven of claim 1, wherein, the controller comprises a first resistor, a triode and a diode, which are connected with one another, wherein the diode and the electric control valve are connected in parallel.

15. The oven of claim 14, wherein, the controller further comprises a second resistor; wherein a first end of the first resistor is connected with an output end of the first IC chip, and a second end of the first resistor is connected with a base of the triode;

a collector of the triode is connected with an anode of the diode and the first end of the electric control valve, an emitter of the triode is grounded, and the second resistor is connected between the base and the emitter of the triode; and a cathode of the diode is connected with a DC power supply after being connected with a second end of the electric control valve.

16. The oven of claim 14, wherein, the controller further comprises a second resistor; wherein the first end of the first resistor is connected with the output end of the first IC chip, and the second end of the first resistor is connected with the base of the triode;

the emitter of the triode is connected with the cathode of the diode and the first end of the electric control valve, the collector of the triode is grounded, and the second resistor is connected between the base and the emitter of the triode; and the anode of the diode is connected with the DC power supply after being connected with the second end of the electric control valve.

* * * * *